US005517896A

United States Patent [19]

Perrine

[11] Patent Number: 5,517,896

[45] Date of Patent: May 21, 1996

[54] SEMI-AUTOMATIC HANDGUN WITH INDEPENDENT FIRING SPRING

[76] Inventor: Walter E. Perrine, 6707 W. Flower St., Phoenix, Ariz. 85033

[21] Appl. No.: 335,170

[22] Filed: Nov. 7, 1994

[51] Int. Cl.[6] ..... F41A 3/50

[52] U.S. Cl. ..... 89/189; 42/25; 42/69.02; 89/144

[58] Field of Search ..... 42/69.02; 89/144, 89/189

[56] References Cited

U.S. PATENT DOCUMENTS

| | | | |
|---|---|---|---|
| 1,159,417 | 11/1915 | Revelli | 89/144 |
| 4,719,841 | 1/1988 | Perrine | 89/189 |

FOREIGN PATENT DOCUMENTS

| | | | |
|---|---|---|---|
| 1135797 | 8/1962 | Germany | 42/69.02 |
| 14844 | of 1912 | United Kingdom | 42/69.02 |

*Primary Examiner*—Stephen C. Bentley
*Attorney, Agent, or Firm*—Gregory J. Nelson

[57] ABSTRACT

A firearm having a toggle and bolt assembly. The bolt is reciprocal and houses a firing pin connected to a driver which are spring biased by the recoil springs. The firing pin is independent of the bolt and is engaged by a trip and sear mechanism when the weapon is initially cocked. The recoil springs act also as firing pins but are taken out of the system when the gun is cocked. The toggle mechanism is biased toward a bolt closed position by a handle spring. The ejector and trigger are held in place by pins in blind bores to prevent ready conversion to automatic firing.

10 Claims, 6 Drawing Sheets

66
66A
68
64
64A
78
17
50
80
91
94
90
92
60
62
86
87
82
63
85
72
58
8

SEMI-AUTOMATIC HANDGUN WITH INDEPENDENT FIRING SPRING

BACKGROUND OF THE INVENTION

The present invention relates to a semi-automatic firearm and more particularly relates to an independent firing pin mechanism for weapons of this type.

Field of the Invention

Semi-automatic weapons such as rifles and pistols of the closed bolt design have a firing pin which is tripped or released from a cocked position when the gun is fired to release the firing pin to contact the cartridge primer exploding the cartridge and firing a bullet. The bolt, due to gas pressure generated, retracts to counteract the effects of firing recoil and also to allow extraction of the spent casing and to load a new round into the chamber. In conventional weapon design, separate springs are provided to oppose the effects of recoil and to drive the firing pin forward to a firing position.

Semi-automatic weapons are weapons which require the trigger be pulled each time a cartridge is fired. On the other hand, automatic weapons will continue to fire rapidly without the requirement of the trigger being pulled each time the shell or cartridge is fired. Federal gun regulations place restrictions on the manufacture, sale and distribution of semi-automatic weapons, particularly those which can be readily converted to automatic weapons. Accordingly, the present invention relates to an improved and effective firearm in which the recoil springs also act as firing pin springs, eliminating the need for one or more independent firing pin springs. Further, the firearm of the present invention is constructed so as not to be readily convertible into a fully automatic weapon thereby complying with the requirements of the Federal firearm laws.

Applicant's U.S. Pat. Nos. 3,630,119; 3,661,049; 3,709,091; 3,732,779; 3,748,961; 3,783,739; 4,126,079; 4,183,282; 4,467,698; and 4,719,841 all relate to automatic weapons of this general type. These patents are believed to be the closest prior art. These patents as well as other prior art patents differ from the present invention in a number of significant ways: None of the prior art toggle mechanism designs utilize the springs which urge the bolt forwardly resisting recoil also as firing pin springs which drive the firing pin forwardly. Another significant advance resides in the construction and installation of the trigger assembly, bolt release and ejector which can only be altered by extensive reconstruction of the firearm.

SUMMARY OF THE INVENTION

In accordance with the present invention, a new and improved firearm mechanism is disclosed in which the recoil springs also serve as the firing pin springs. The recoil springs are inactive and are out of the system when the weapon is cocked. The recoil springs are, in the preferred embodiment, two large springs which provide positive firing action to reduce the possibility of mis-fires and eliminate the requirement for an additional independent firing spring. This both simplifies the construction and increases weapon reliability.

It is therefore, an object of the present invention to provide a new and improved firearm in which manual force applied to the trigger initially releases the bolt to a forward position when chambering the first round but retains the firing pin in a retracted position. Upon a subsequent pull of the trigger, the weapon will fire as the firing pin is driven forward by the large recoil springs. The bolt release will not interfere with firing after the initial round in the sequence is fired as it is rotated to an out-of-the-way position. After the initial round is fired, the firearm operates as a semi-automatic weapon requiring a single pull of the trigger for each round fired.

It is another object of the present invention to provide a trigger sear and trip mechanism which cooperates with the firing pin to engage the firing pin in a cocked position for sequential firing after the first round is fired.

It is still a further object of the present invention to provide an improved semi-automatic weapon in which the trigger mechanism, sear, trip and firing pin are configured and installed so that they may not be readily converted to automatic firing in contravention of the firearm laws.

Another object of the invention is to provide an improved weapon having a toggle bolt mechanism which resists "bounce" of the bolt upon recoil.

Another object of the invention is to provide an improved toggle type bolt action in which recoil forces are absorbed in accelerating and decelerating the toggle resulting in a weapon which has less recoil to better remain on the target line when fired.

Still another object is to provide a bolt that is cam assisted and which cam operates against the frame to initiate manual cocking.

Briefly, the firearm of the present invention has a frame which houses a reciprocable bolt pivotally attached to a rear link by an intermediate center link in a toggle arrangement. A handle spring acts between the handle and the rear link. An independent firing pin is reciprocable within the bolt. A pair of recoil springs act against the bolt when the bolt is forward and are also connected to the firing pin by a driver. The firing pin carries a projection engageable by a trip associated with the trigger mechanism. The weapon is initially moved to a full cocked position by a lever and cam which breaks the bolt and moves it rearwardly. When the trigger is pulled, the trip is forced downward by a sear. As the trigger continues to rotate, the bolt release located adjacent the trigger rotates and the trip reaches its lowest point of travel forcing the sear to retreat into the trigger allowing the trip to move upwardly returning to its uppermost position in which it will engage the projection on the firing pin when the bolt is released from the full cock position.

When initial trigger pressure is applied, the bolt moves forward and the firing pin is engaged by the trip. The bolt continues to move under the force of the handle spring acting on the rear link to chamber a round and close the bolt. When the trigger is pulled a subsequent time, the firing pin is released and driven forward by the recoil springs.

When the trigger releases the bolt on chambering the first round, the bolt release is pivoted and does not interfere with firing subsequent rounds in the sequence. This construction eliminates the need for independent firing springs. The handle spring acts against the rear link to prevent "bounce" or recoil which normally occurs in toggle actuated firearms. The handle spring acting against the rear link of the toggle basically holds the components in place resulting in substantially less recoil transmitted to the shooter improving the ability of the shooter to maintain the weapon on target.

The components including the ejector, trigger and bolt release are installed by pins in the frame which are either placed in blind holes or welded in a manner that attempts at converting the weapon to automatic firing are not possible without extensive reconstruction.

The handgun has a "clamshell" design in which the barrel and shroud are retained by a releasable shroud retainer. The firearm receives a removable clip or magazine. An extractor is carried on the bolt and acts to remove the spent cartridge. The forward travel of the bolt engages a live round to move it forward and chamber the round.

The weapon is easily disassembled for cleaning and is of a compact, rapid firing design which may be manufactured in various calibers.

Further objects and advantages of the present invention will become more apparent from the following description taken in connection with the appended claims and drawings in which:

BRIEF DESCRIPTION OF THE DRAWINGS

FIGS. 2 through 6 are cross sectional views of a portion of the weapon illustrating the sequence of operation with:

FIG. 2 showing a full cocked position;

FIG. 3 showing the weapon when the trigger is pulled;

FIG. 4 is a loaded, ready to fire position;

FIG. 5 showing the weapon after firing the first round; and

FIG. 6 where the weapon is shown empty and the last round has been fired;

DESCRIPTION OF THE PREFERRED EMBODIMENT

Figures 1, 13, 14, 15:
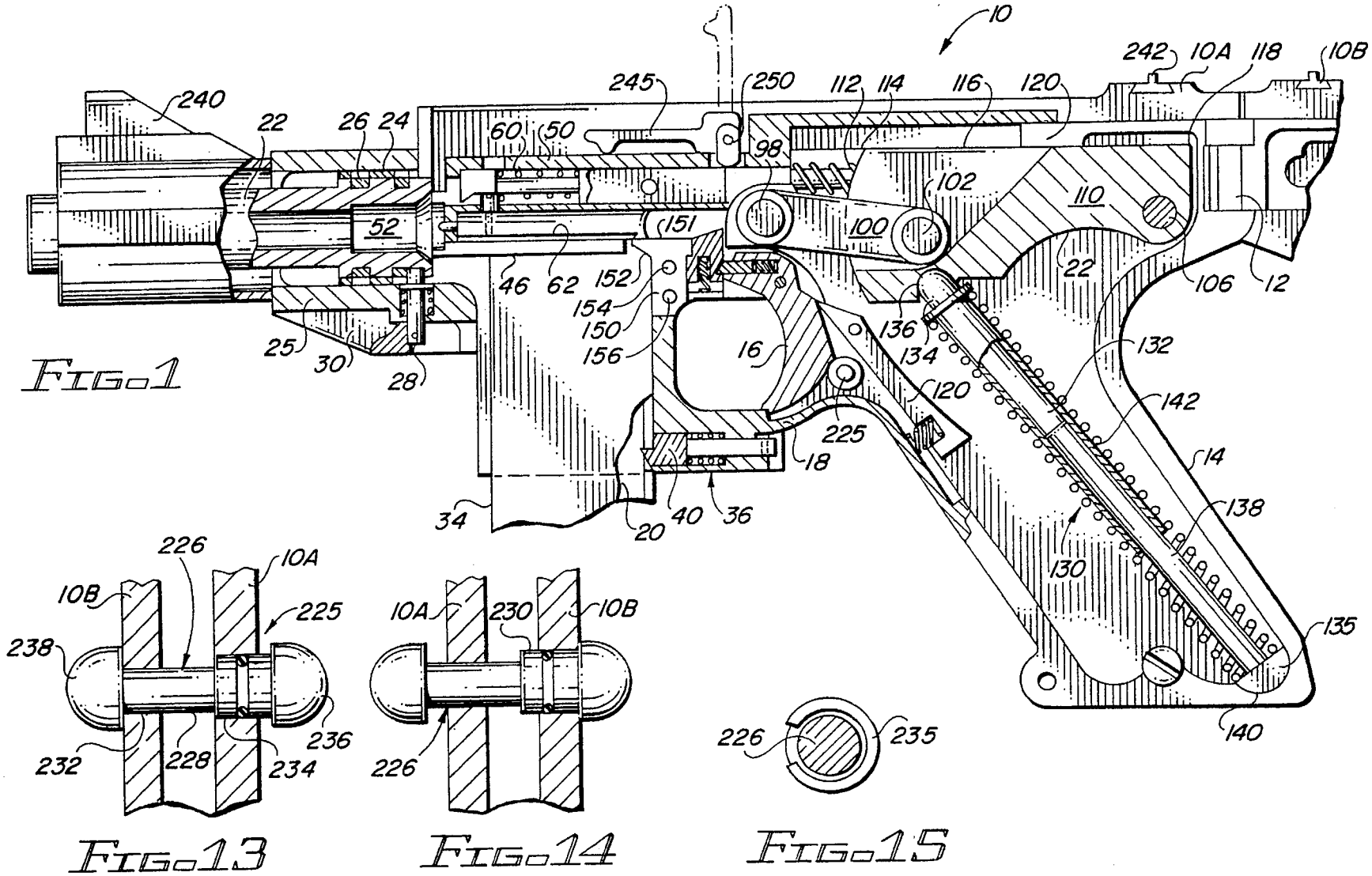
FIG. 1 is a side view of the firearm of the present invention shown ready to be cocked which figure is partly in section and partly broken away for clarity.
FIGS. 13 to 15 show the stop pin safety with FIG. 13 showing the safety "off" and FIG. 15 shows the safety "on"

Referring to the drawings, a firearm such as a handgun is generally illustrated having a frame 10 comprising two interconnected parts 10A and 10B which pivot about a hinge 12 between an open and closed position in an arrangement sometimes referred to as a "clam shell" action. The frame section 10A defines a handle 14, a trigger 16, trigger guard 18, and a magazine chamber 20. A detachable barrel 22 is received in the annular grooves 26 of section 24 at the front of the frame. The barrel is locked in place by the shroud 25. "Front" as used herein refers generally in a direction toward the barrel end of the pistol and "rear" refers to a direction toward the handle 14.

The shroud 25 extends annularly around the barrel and the shroud section 24 and is retained by a spring biased detent pin 28 which is pivotally moved into and out of the shroud retaining position by a detent lever 30.

Figure 2:
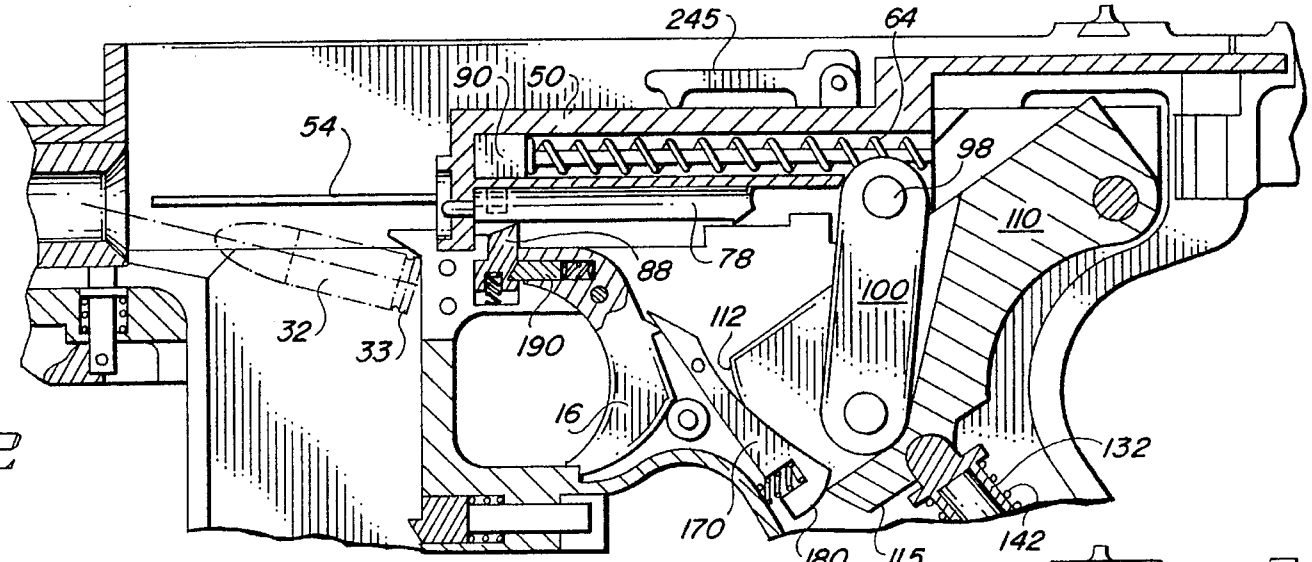
Figure 3:
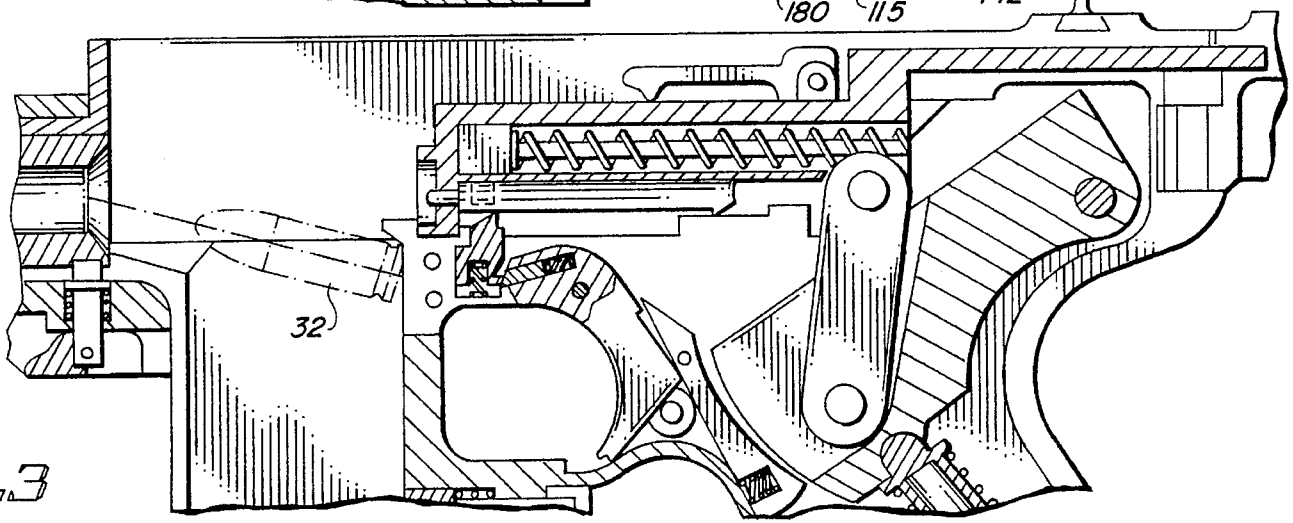
Figure 4:
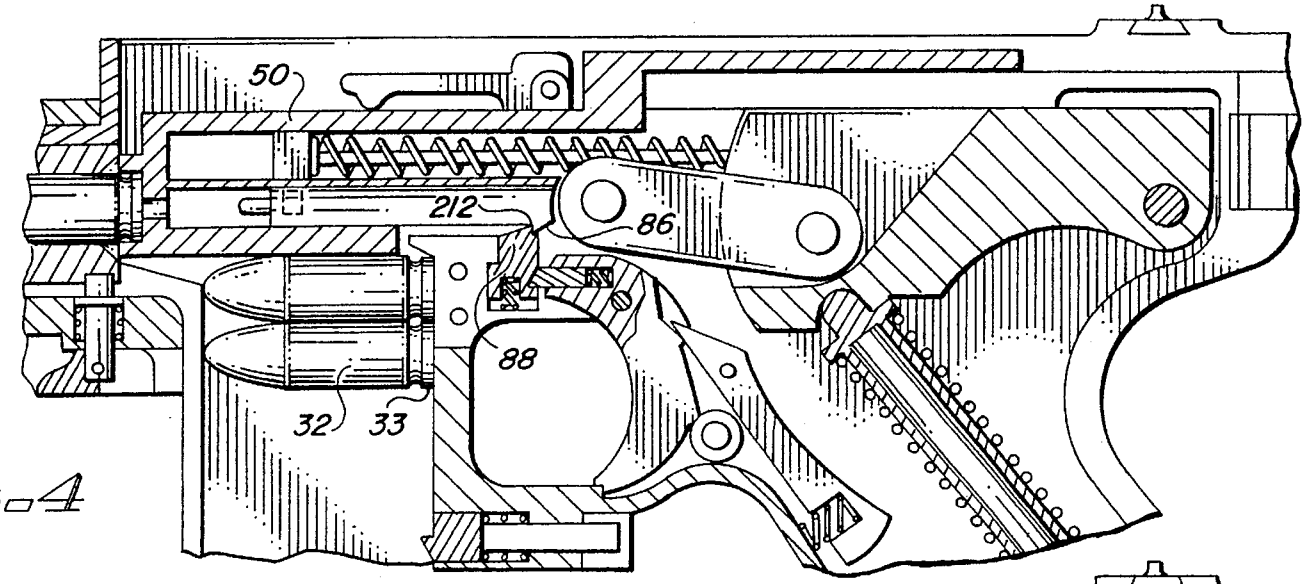

Cartridges 32, as seen in FIGS. 2, 3 and 4, are maintained in clip 34 insertable in the magazine chamber 20. The clip 34 is released by clip release 36 which has a detent pin 40 engageable with the clip. The clip is loaded with cartridges 32 which are biased upwardly in the clip by a spring, not shown, as is conventional. The upper end of the clip aligns with an opening 46 in the frame so that the cartridges will be in a position to be engaged by the bolt 50 and transferred into the cartridge chamber 52 by the bolt as it moves forward.

The bolt 50, as best seen in FIGS. 7, 8, 8A and 9, is generally elongate and reciprocates within the frame along longitudinal guide ribs 54 on the opposite frame sections. The forward end of the bolt has a face plate 58 which, when the bolt is forward, is spaced from the rear of the cartridge chamber 52 by a small clearance such as 0.002". The bolt 50 defines two generally longitudinally extending chambers 60, 62. A pair of compression springs 64, 64A are disposed in side-by-side relationship along opposite sides of the upper chamber 60. The springs 64, 64A are disposed about guide rods 66, 66A which extend rearwardly and each terminate at an enlarged head 68. The guide rods are arranged in parallel relationship on each side of the upper bolt chamber 60 with the front end of the rods secured to an annular washer 63 in the face 58.

Figure 18:
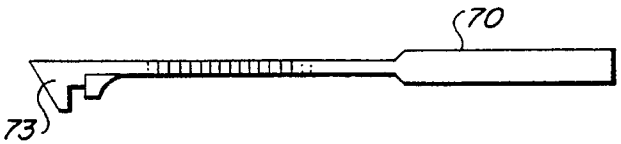
FIG. 18 is a side view of the extractor.

An extractor 70 is connected to the bolt at 72 and extends forwardly through an opening at the forward end of the bolt face plate. The extractor is positioned intermediate the guide rods and the forward end of the extractor carries a hook 73 which is notched and is positioned to engage the rim 33 of the spent cartridge to extract the cartridge casing from the chamber 52 after the cartridge has been fired as the bolt moves rearwardly due to recoil. FIG. 18 illustrates the extractor and in FIG. 8A the position and top of the extractor are seen.

Figure 9:
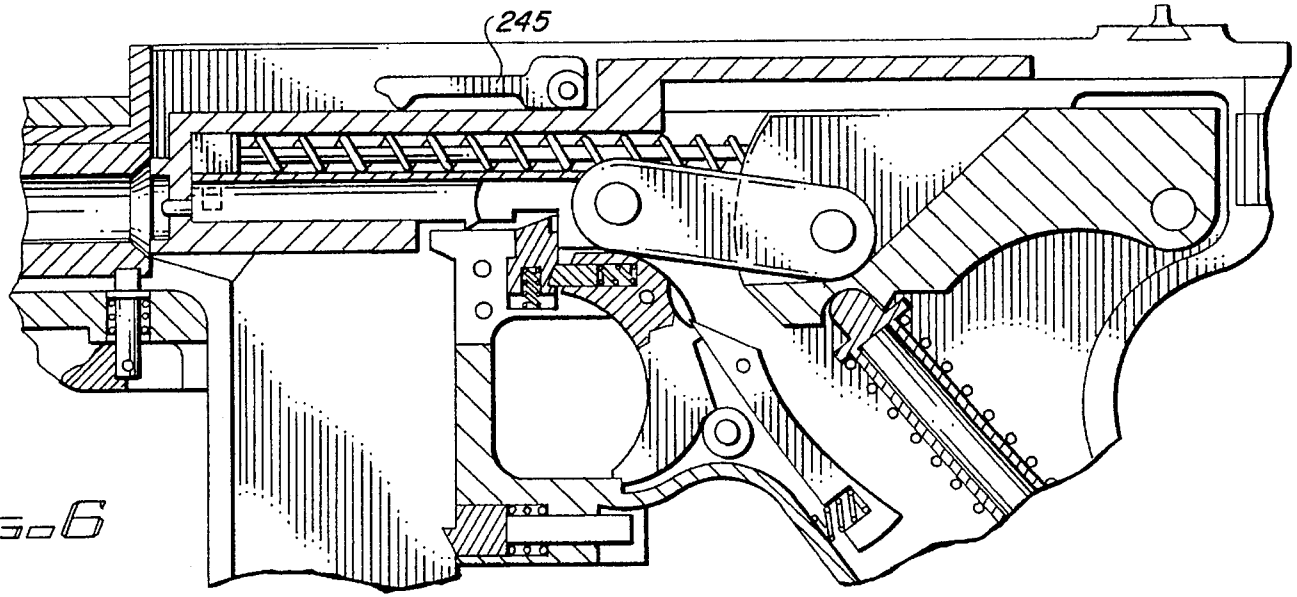
FIG. 9 is an exploded view of the belt, driver and firing pin.
Figures 7, 9, 10, 17:
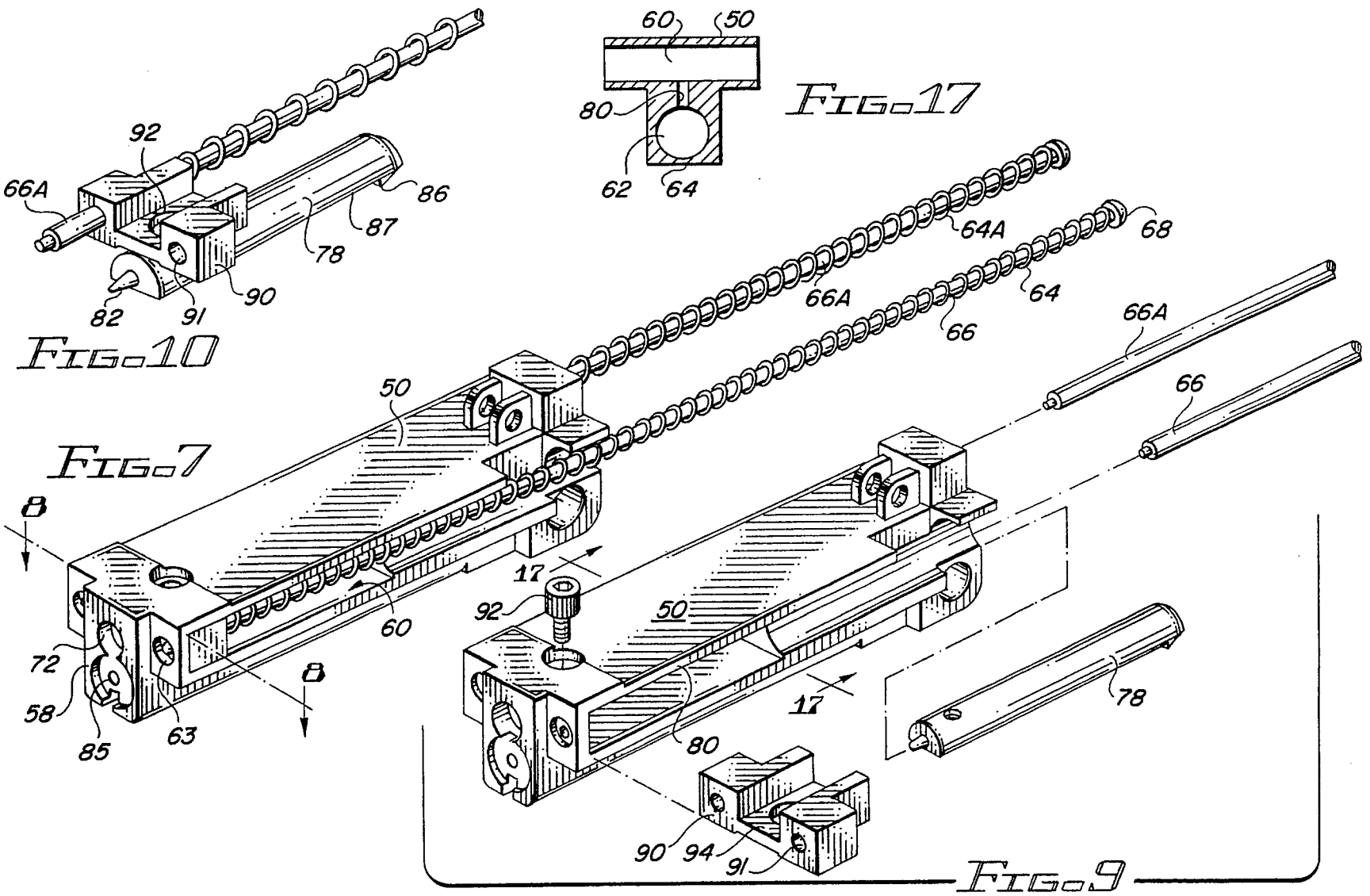
FIG. 7 is a perspective view of the bolt, driver and recoil spring.
FIG. 10 is a perspective view showing the driver and firing pin.
FIG. 17 is a sectional view taken along line 17—17 of FIG. 9.

As indicated above, an important aspect of the invention is the independent firing pin mechanism. Bolt chamber 62 slidingly receives the firing pin 78. Chambers 60, 62 are interconnected by longitudinally extending slot 80 as seen in FIG. 17. The forward end 82 of the firing pin 78 aligns with the aperture 85 in the bolt face and also aligns with the primer of a cartridge when a cartridge is in the chamber. Upon impact, the pin will cause the cartridge to explode.

The bottom of chamber 62 defines an elongate slot 84. The bottom surface of the firing pin is flat at 87 configured having a tab 86 at a rearward location. The tab 86 projects through the longitudinal slot 84 and, as will be explained hereafter, is engaged by a trip 88 when the weapon is initially placed in a cocked, ready-to-fire position.

Figure 8:
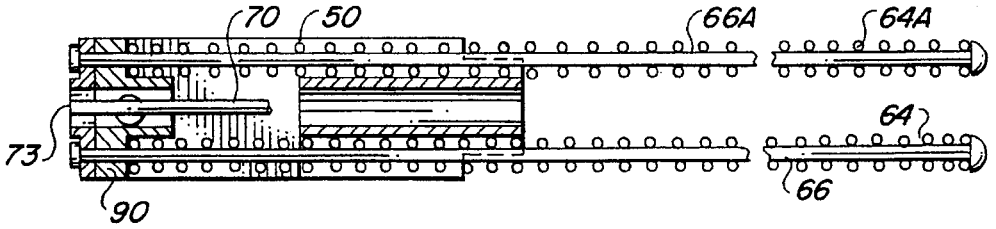
FIG. 8 is a sectional view of the bolt and driver, recoil springs and rod taken along line 8—8 of FIG. 7.
Figure 8A:
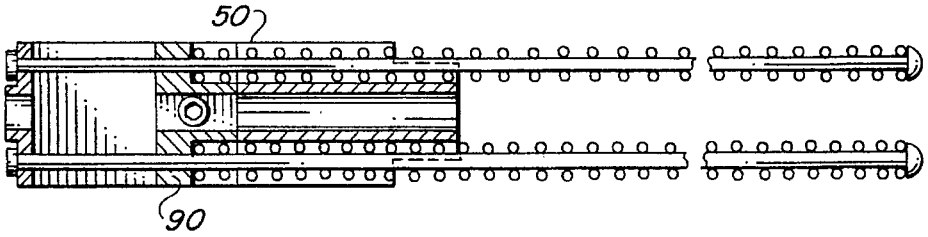
FIG. 8A is a view similar to FIG. 8 with the bolt forward and firing pin driver retracted.

In contrast to conventional weapon design, the firing pin 78 is not driven forward by one or more separate firing springs but, instead is independent being drivingly connected to the compression springs 66 and 66A which springs also serve as recoil springs. Accordingly, a driver 90, as best seen in FIGS. 9 and 10, is reciprocal within chamber 60 along rods 66 and 66A which extend through holes 91. A firing pin driver connector 92 extends from the driver 90 through the elongate slot 80 connecting the forward end of the firing pin 78 to the driver. The driver is provided with a central recess 94 to accommodate the extractor 70 as seen in FIG. 8. Springs 64 and 64A abut the driver at their opposite ends, the heads 68 of the guide rods.

The weapon employs a bolt and toggle mechanism and accordingly the rear end of the bolt is pivotally connected by a pivot pin 98 to center link 100. The opposite end of link 100 is connected to rear link 110 at pivot pin 102. The rear link is, in turn, pivotally connected to the frame at pivot pin 106 mounted in the rear portion of the frame section 10A. Links 100 and 110 provide a toggle linkage which controls and responds to movement of the bolt. The rear link is configured having an arcuate section 112 to provide contoured surface to allow the link to smoothly rotate downwardly about pivot point 106. Arcuate surface 112 curves smoothly to point 114 at which point a linear surface 116 extends rearwardly to point 118. A shoulder 115 is provided along surface 112. In the bolt forward position, the linear surface 116 of the rear link abuts a stop 120 on the upper rear frame. A recess 122 is provided in the lower surface of the link to provide clearance with the rear curvature of the handle 14 when the link rotates downwardly.

A push rod assembly 130, also termed the "handle spring", has an upper cylindrical rod member 132 having a head 134 which is seated in recess 136. Rod 138 is telescopically slidable within rod member 132 having a lower end 135 which is seated within a recess 140 in the lower end of the handle section of the frame. A compression spring 142 extends between the opposite end members 134 and 135 providing a biasing force which acts against the rear link 110.

Cartridges are thrown from the weapon by an ejector 150. The extractor 70 engages the spent cartridge casing and carries it rearwardly. The ejector 150 is positioned at the upper end of the magazine chamber and has upper horizontal surface 151 against which a portion of the firing pin slides. The ejector has a forwardly extending flange 152 which extends above the magazine chamber and assists in directing the top cartridge in the clip into the chamber when the bolt slides rearward as seen in FIGS. 2 and 3. The ejector is held in place by spaced-apart pins 154, 156. The pins 154, 156 may be roll pins of hardened steel and are received in blind bores in frame section 10A making tampering with or removal of the pins and the extractor very difficult. These pins are not readily accessible from the exterior of frame section 10A and removal would require machining including drilling out the pins and replacing with new pins and then welding the pins in place.

Figure 16:
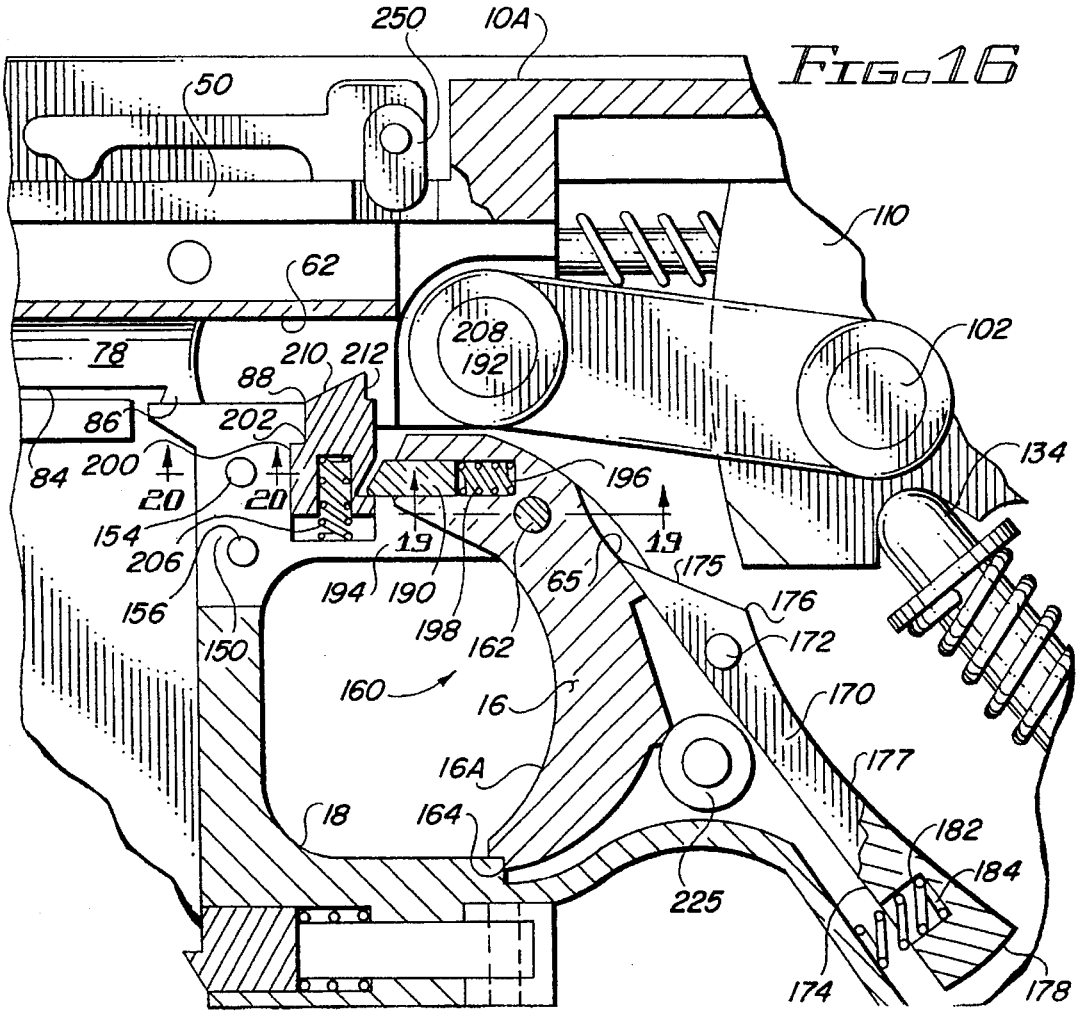
FIG. 16 is a detail view of the trigger assembly.

The trigger mechanism 160 is shown in detail in FIG. 16 and includes a trigger 16 having an arcuate curved surface 16A against which the forefinger of the user rests and to which manual pressure is applied when the weapon is fired. The trigger mechanism is enclosed within a trigger guard 18. The trigger 16 is pivotal about pivot pin 162 which is hardened steel welded to the frame section 10A. In the normal non-actuated position, the lower end of the trigger rests against the trigger guard at shoulder 164. The rear of the trigger is configured having a cam surface 165 which engages the front side of the upper end of the bolt release 170. The bolt release 170 is positioned rearward of the trigger and is pivotal about bolt release pivot pin 172 which is also hardened steel which is welded in place. The bolt release has a generally planar surface 174 which near its upper end engages trigger cam surface 165. The bolt release is configured having a rearwardly angular surface 175 extending from the upper end to a location 176. The rear surface 177 of the bolt release from point 176 to the lower end 178 is generally smoothly contoured having a curvature conforming to the curvature of the lower end 112 of the rear link. The lower end 180 of the bolt release is also arcuate. A blind bore 182 is provided in the front surface 174 of the bolt release near the lower end which receives one end of compression spring 184, the other end engaging the interior of handle section of frame section 10A.

A unique sear and trip mechanism operates in connection with the firing pin to engage the firing pin in a ready-to-fire position upon initial trigger pressure being applied. Referring to FIG. 16, the upper end of the trigger is provided with a blind bore 186 which slidingly receives sear 190. The forward end of the sear is configured having forwardly angled cam surface 192 which intercepts a shorter, rearwardly extending surface 194. A spring 196 in bore 198 biases the sear forwardly.

Trip 88 is vertically slidable in a slot 200 extending from the trigger guard and intercepting the path of travel of the firing pin. The trip 88 has a shoulder 202 which engages a projection on the rear surface of the ejector 150 which limits the upper travel of the trip to the position shown in FIG. 16. A spring 206 biases or urges the trip upwardly. The rear surface of the trip defines a generally horizontally oriented V-shaped notch 208 which is engaged by the sear during certain positions in the firing sequence, as will be explained. The upper end of the trip 88 defines a rearwardly inclined surface or ramp 210 extending to a vertical shoulder 212 at the rear of the upper surface of the trip.

FIGS. 13 to 15 disclose a trigger safety 225 which comprises a stepped pin 226 with opposite heads 238 and 239 having a small diameter section 228 and a larger diameter section 230 held in frictional engagement in bores 232 and 234 of the frame sections 10A and 10 by a split ring spring 235. As shown in FIGS. 1 and 16, the trigger safety is mounted on the frame of the weapon between the trigger 16 and the bolt release 170 such that when the small diameter section 228 of the pin is positioned behind the trigger as shown in FIG. 13, both the trigger and bolt release are unobstructed and are free to move. When the safety is moved axially by depressing the safety to the position shown in FIG. 14, the larger diameter 230 of the pin is positioned between the small projection on the rear of the trigger and in engagement with the front surface of the bolt release locking these components against movement and preventing discharge of the firearm.

Figure 12:
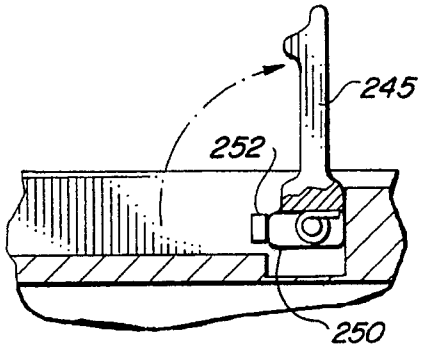
FIGS. 11 and 12 show the cocking or charging mechanisms.
Figure 11:
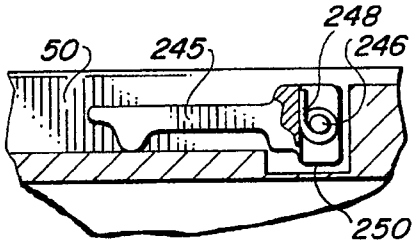

As is conventional, front and rear sights 240, 242 are provided at spaced-apart locations along the upper surface of the frame 10. Also provided is a charging or cocking lever 245 as best shown in FIGS. 11 to 12. In order to cock the weapon and move the bolt rearwardly, the lever 245 is pivotally mounted on the bolt 50 at pin 246 so that when the charging lever is pivoted to an upright position against spring 248, it assumes a vertical position. The lever has a cam surface 250 which is disposed downwardly when the lever is horizontal. The user can pull the bolt 50 rearwardly by applying rearward pressure to the charging lever causing the cam 250 to engage the surface 252 of frame section 10B which moves the bolt rearwardly in the direction of the area to break the lock of the toggle.

A more complete understanding of the firearm of the present invention will be had from the following description of sequence firing operations. In referring to FIGS. 1 through 6, the firing sequence is shown. In FIG. 1, the weapon 10 is shown in a ready to be cocked position in which the bolt 50 and firing pin 78 are both fully forward. The rear link 110 is against the stop 120 held in place by the handle spring 142. A clip 34 is shown inserted in the magazine chamber 20 loaded with cartridges 32 although no cartridge is yet positioned in the cartridge chamber 52 in this position. The safety 225 is in the "off" position, not engaging or blocking the trigger or bolt release.

The firing sequence is initiated by rotating the charging lever 245 vertically to bring the cam 250 against the frame breaking the toggle lock and manually moving the bolt rearward from the position shown in FIG. 1 to position the bolt as shown in FIG. 2. As the bolt is moved rearwardly along its guides, the recoil springs 64, 64A are compressed. The rearward movement of the bolt also carries the driver 90 rearwardly which, in turn, slides the firing pin rearwardly within its chamber 62. The center link 100 pivots downwardly as the pivot point 98 moves rearwardly. The downward movement of the center link causes the rear link 110 to pivot downwardly about its pivot point 102. The forward surface 112 of the rear link, being curved, will engage and move smoothly along the curved rear surface 177 of the bolt release 70. As the rear link pivots downwardly, it forces the upper rod member 132 downwardly compressing spring 142 of the handle spring. The weapon is then held in the full-cocked position shown in FIG. 2 by the engagement of the lower end 180 of the bolt release 170 engaging shoulder 115 at the forward edge of the rear link. The upper end of the forward edge of the bolt release engages the rear of the trigger.

When the trigger 16 is pressed rearwardly, trip 88 is forced downwardly by the sear 190 as the trigger rotates around pivot pin 162. The bolt release is caused to rotate about pivot 172 by the trigger as the trigger moves to the rear. The rotation of the bolt release depresses spring 184. As the trigger continues to rotate, the trip 88 reaches the point of lowest travel due to the forward movement of the sear 190. When this point is reached, sear 190 is forced to retract rearwardly into its bore 198 against the biasing force of spring 196. The weapon is prepared to "drop" the bolt and load a cartridge as seen in FIG. 3.

As sear 190 is retracted, it allows the trip 88 to return to its upper-most position where the trip is in a position to catch or engage the firing pin shoulder 85 once the bolt is released. As the trigger continues its rotation, the bolt release is further rotated sufficiently until the bolt release engages shoulder 115 on the lower end of the rear link. The bolt 50 is now free to move forward and as the bolt moves to its forward position, the trip at shoulder 202 will engage the shoulder 86 on the firing pin as seen in FIG. 4. Thus, the firing pin is retained in a rear position with springs 64 and 64A compressed while the bolt 50 is allowed to move fully forward. During the forward movement of the bolt, the bolt will engage a cartridge 32 and carry it forward into the cartridge chamber 52. The bolt continues to move forward after the firing pin is engaged by the biasing force exerted by the handle spring. The handle spring 142 forces the bolt to chamber a cartridge and cock the firing pin with the bolt being moved to the closed position ready for firing. The loaded ready-to-fire position is shown in FIG. 4.

Figure 5:
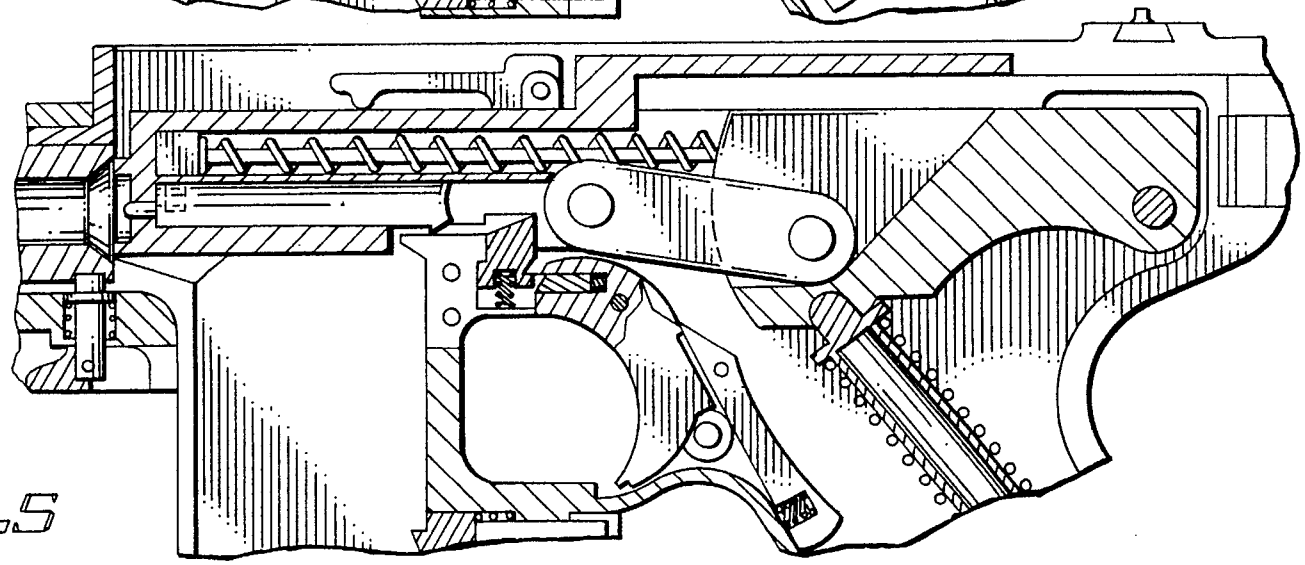

Upon the trigger being released and pulled a second time, the upper end of the trigger will move forward moving the sear forwardly causing the trip 88 to retract to disengage the firing pin. The recoil springs 66, 66A are connected to the firing pin by means of the driver 90 and connector 92 and now will exert full force to drive the firing pin forward to bring the firing pin into engagement with the primer of the shell cartridge. The gun fired position is shown in FIG. 5.

After the initial round is fired, the weapon is semi-automatic requiring only a single trigger pull per round as the bolt release will not interfere with firing. The rapidity of the sequence is faster than human reaction time so the trip can not be positioned to engage the firing pin. In FIG. 6 the weapon is shown in an empty position.

A number of important operating features result from the construction described above. When the trigger releases the bolt to chamber in the first round, the bolt release will not interfere with the firing as it is rotated to an off position to catch the bolt when fired. The timing sequence is important as the trip 88 must release first and continued rotation of the trigger will release the bolt. If the bolt is released first, the trip will not engage the firing pin and firing the weapon will not occur.

Once the first round is fired, the explosive force of the cartridge will discharge the bullet into the barrel of the weapon. The explosive force will also generate rearward pressure on the bolt 50 and will drive the bolt 50 and extractor 70 which is attached to the bolt rearwardly. The spent cartridge casing is held by the extractor until the empty cartridge strikes the ejector 150 and is ejected from the weapon. The inertia of the rearward action of the bolt will compress the recoil compression springs. The handle springs will resist the "bounce" tendency and maintain the rear link in position against its stop.

The toggle absorbs recoil by accelerating and decelerating. Initially, as the bolt moves rearwardly, the center link moves the rear link downwardly faster than the bolt moves rearwardly. At an angle of about 23°, the movement is about 1:1. As the center link is vertical, the rear link is no longer moving and both recoil springs are out of the system. As the toggle linkage moves forward, the handle spring becomes effective. Field tests have indicated a reduction in recoil transmitted to the shooter of over 70% as compared to comparable, conventional design weapons.

After the first shot, the bolt release is forward and does not interfere with the action of the handgun. Therefore, after the first round in a sequence, the bolt will move rearwardly with the extractor ejecting the shell and casing and, once it reaches the fully retracted position, will due to the force of the compression springs and the handle spring move forwardly chambering a new round. The firing pin will be engaged by the trip which is in the fully "up" position. Thus, firing will not occur until the trigger is pulled again. Thus, the weapon is semi-automatic requiring two trigger pulls on the initial firing round and a single trigger pull after firing of the first round.

Thus, it will be seen that the weapon has a number of advantages. One primary advantage is that it eliminates firing pin spring as it uses recoil springs also as the firing pin spring. The recoil springs are taken out of the system when the gun is cocked as the two springs are inactive in this position. The components of the weapon are held in place by the handle spring overcoming a problem common to prior art toggle actuated bolt systems. The two large recoil springs provide positive firing action reducing mis-fires and eliminates the need for an independent firing spring. The toggle, recoil spring and handle spring provide a repetitive action. The safety locks the trigger in the forward position.

The weapon is considered inalterable in that it cannot be readily converted to automatic fire. Converting the weapon to automatic fire would in essence require re-manufacturing the weapon. This is because the trip is not removable as the weapon will not work without the trip. The trigger and sear are held in place by hardened pins in blind bores as is the extractor. Therefore, attempted removal of any of the components will render the weapon inoperable. Attempts at converting the weapon to automatic operation can only be achieved by extensive reconstruction well beyond the ability of most individuals.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A weapon for firing a cartridge having a casing, shell and a primer, said weapon comprising:

(a) a frame having a front and rear and having a handle, said frame having a stop surface rearwardly located on the frame, said frame defining an axially extending bolt chamber;

(b) a barrel extending from the front of said frame having a cartridge chamber generally aligned with said bolt chamber;

(c) a trigger assembly including:

(i) a trigger pivotally mounted in said frame on a pivot pin;

(ii) said trigger defining a bore receiving a sear; and (iii) a trip having a trip surface, said trip biased upwardly toward said bolt chamber with said sear operatively engaging said trip;

(d) a bolt axially slidable in said bolt chamber in said frame between a first rearward position and a forward position adjacent said cartridge chamber, said bolt defining a firing pin chamber generally axially aligned with said barrel;

(e) a firing pin slidable in said firing pin chamber independent of said bolt and having a section thereon adapted to be engaged by said trip;

(f) a pair of springs extending axially within said frame each having a rear end acting against the frame and a forward end acting against said bolt, said springs being connected to said firing pin at a firing pin driver;

(g) a first toggle link having a first end pivotally connected to said bolt and having an opposite end;

(h) a second toggle link pivotally connected at a rear end to the frame and pivotally connected to the opposite second end of said first toggle link;

(i) a bolt release pivotally secured to the frame at a pivot point rearward of the trigger assembly and engaging at least a part of said trigger assembly and having a surface engageable with the second toggle link when said bolt is in said fully cocked position; and (j) a handle spring extending between said frame handle and said second toggle link and urging said second toggle link toward said stop surface when said weapon is in said fully cocked position, whereby initial pressure applied to said trigger will pivot said bolt release, releasing said second toggle link permitting said bolt to move forward to allow said trip to engage said firing pin at said section and whereby subsequent trigger pressure will release said firing pin driven by said springs to cause said firing pin to engage the cartridge primer in a firing position and whereby subsequent firing in the sequence is semi-automatic requiring only an initial trigger pressure to release the bolt and firing pin to a firing position.

2. The weapon of claim 1 further including a magazine-receiving chamber forward of the trigger assembly opening into the bolt chamber.

3. The weapon according to claim 1 further including a lever pivotally mounted on said bolt and extending in an actuated position from said bolt, said lever having a cam surface engageable with the frame to manually move said bolt rearwardly away from said cartridge chamber causing said rear link to pivot away from its stop.

4. The weapon of claim 3 wherein said lever is spring biased to a first nonactuated position generally axially aligned with said bolt.

5. The weapon of claim 1 wherein the second toggle link has a curved surface and wherein said bolt release has a curved rear surface conforming to the curvature of the second toggle link whereby upon release of the second toggle link from a cocked position, the second toggle link will pivot upwardly about its pivot point along said rear surface of said bolt release.

6. The weapon of claim 1 wherein said trip surface is a rearwardly inclined ramp having a shoulder at the rear edge of the ramp and wherein said sear is spring biased and engaged in a generally V-shaped notch disposed in the side of said trip.

7. A weapon for firing a cartridge having a casing, a shell and a primer, said weapon comprising:

(a) a frame having a front and rear and having a handle, said frame having a stop surface rearwardly located on the frame, said frame defining an axially extending bolt chamber;

(b) a barrel carried from the front of said frame having a cartridge chamber generally aligned with said bolt chamber;

(c) a trigger assembly including:

(i) a trigger pivotally mounted in said frame on a pivot pin;

(ii) said trigger defining a bore receiving a sear;

(iii) a trip having a trip surface, said trip biased upwardly toward said bolt chamber with said sear operatively engaging said trip;

(d) a bolt axially slidable in said bolt chamber in said frame between a first rearward position and a forward position adjacent said cartridge chamber, said bolt defining a firing pin chamber generally axially aligned with said barrel;

(e) a firing pin slidable in said firing pin chamber independent of said bolt and having a section thereon adapted to be engaged by said trip;

(f) at least one spring having a forward end connected to said firing pin at a firing pin driver and having an opposite end acting against said frame;

(g) a first toggle link having a first end pivotally connected to said bolt and having an opposite end;

(h) a second toggle link pivotally connected at a rear end to the frame and pivotally connected to the opposite second end of said first toggle link;

(i) a bolt release pivotally secured to the frame at a pivot point rearward of the trigger assembly and engaging at least a part of said trigger assembly and having a surface engageable with the second toggle link when said bolt is in said fully cocked position;

(j) a handle spring extending between said frame handle and said second toggle link and urging said second toggle link toward said stop surface when said weapon is in said fully cocked position, whereby initial pressure applied to said trigger will pivot said bolt release, releasing said second toggle link permitting said bolt to move forward to allow said trip to engage said firing pin at said section and whereby subsequent trigger pressure will release said firing pin driven by said spring to cause said firing pin to engage the cartridge primer in a firing position and whereby subsequent firing in the sequence is semi-automatic requiring only an initial trigger pull to release the bolt and firing pin to a firing position;

(k) an extractor extending axially and attached to said bolt having a forward end engageable with the cartridge to extract the spent cartridge from the cartridge chamber when the bolt moves rearwardly; and (l) an ejector having a surface extending into said bolt chamber positioned to direct a cartridge into the bolt chamber to a position to be moved by the forward motion of the bolt to the cartridge chamber and a surface for engaging and ejecting a spent cartridge when the extractor moves a cartridge rearwardly.

8. The weapon according to claim 7 further including a lever pivotally mounted on said bolt and extending in an actuated position from said bolt, said lever having a cam surface engageable with the frame to manually move said bolt rearwardly away from said cartridge chamber causing said rear link to pivot away from its stop.

9. A weapon for firing a cartridge having a casing, a shell and a primer, said weapon comprising:

(a) a frame having a front and rear and having a handle, said frame having a stop surface rearwardly located on the frame, said frame defining an axially extending bolt chamber;

(b) a barrel extending from the front of said frame having a cartridge chamber generally aligned with said bolt chamber;

(c) a trigger assembly including:

(i) a trigger pivotally mounted in said frame on a pivot pin;

(ii) said trigger defining a bore receiving a sear;

(iii) a trip having a surface, said trip biased upwardly toward said bolt chamber with said sear operatively engaging said trip;

(d) a bolt axially slidable in said bolt chamber in said frame between a first rearward position and a forward position adjacent said cartridge chamber, said bolt defining a firing pin chamber generally axially aligned with said barrel;

(e) a firing pin slidable in said firing pin chamber independent of said bolt and having a section thereon adapted to be engaged by said trip;

(f) at least one spring having a forward end connected to said firing pin at a firing pin driver and an opposite end acting against said frame;

(g) a first toggle link having a first end pivotally connected to said bolt and having an opposite end;

(h) a second toggle link pivotally connected at a rear end to the frame and pivotally connected to the opposite second end of said first toggle link and having a curved surface;

(i) a bolt release secured to the frame at a pivot point rearward of the trigger assembly and engaging at least a part of said trigger assembly and having a curved surface and conforming to the curved surface of the said second toggle link and engageable therewith when said bolt is in said fully cocked position; and (j) a handle spring extending between said frame handle and said second toggle link and urging said second toggle link toward said stop surface when said weapon is in said fully cocked position, whereby initial pressure applied to said trigger will pivot said bolt release, releasing said second toggle link from a cocked position to pivot upwardly about its pivot point along the curved surface of the bolt release permitting said bolt to move forward to allow said trip to engage said firing pin at said section and whereby subsequent trigger pressure will release said firing pin driven by said spring to cause said firing pin to engage the cartridge primer in a firing position and whereby subsequent firing in the sequence is semi-automatic requiring only an initial trigger pull to release the bolt and firing pin to a firing position.

10. The weapon according to claim 9 further including a lever pivotally mounted on said bolt and extending in an actuated position from said bolt, said lever having a cam surface engageable with the frame to manually move said bolt rearwardly away from said cartridge chamber causing said rear link to pivot away from its stop.

* * * * *